US005261444A

United States Patent [19]

Childers

[11] Patent Number: 5,261,444

[45] Date of Patent: Nov. 16, 1993

[54] PREFABRICATED WATER PLUMBING STATION

[76] Inventor: Billie W. Childers, Rt. 1 Box 445AD, Forest City, N.C. 28043

[21] Appl. No.: 970,107

[22] Filed: Nov. 2, 1992

[51] Int. Cl.[5] ..... F16L 5/00

[52] U.S. Cl. ..... 137/360; 4/695; 220/3.3; 312/242

[58] Field of Search ..... 137/360, 359; 4/695, 4/696, DIG.. 7; 312/229, 242; 220/3.3, 3.8, 3.92

[56] References Cited

U.S. PATENT DOCUMENTS 4,564,249 1/1986 Logsdon ..... 137/360 X
4,637,422 1/1987 Izzi; Sr. ..... 137/360
4,673,097 6/1987 Schuldt ..... 220/3.5

*Primary Examiner*—Martin P. Schwadron
*Assistant Examiner*—Kevin L. Lee
*Attorney, Agent, or Firm*—Richard L. Miller

[57] ABSTRACT

A prefabricated water plumbing station is provided that is a time saving component for installer because it may be installed as a single unit in a wall cavity between two vertical studs. The unit consists of a housing mountable between studs having plumbing hardware (valves and drain connection) for connecting a building's hot and cold water supply and drain lines to a fixture/appliance. A front panel on the housing is provided with a choice of a plurality of alignment lugs for properly positioning the unit from the studs to allow for the installation of paneling and similar materials to the studs about and beneath the front panel after installation thereof.

2 Claims, 1 Drawing Sheet

PREFABRICATED WATER PLUMBING STATION

BACKGROUND OF THE INVENTION

The instant invention relates generally to fitting assemblies and more specifically it relates to a prefabricated water plumbing station.

Numerous fitting assemblies have been provided in the prior art that are adapted to be mounted into walls for connecting water supply pipes and drain line to washing machines and similar appliances. For example, U.S. Pat. Nos. 3,495,276 to Suess; 5,029,606 to Kuhlthau, Jr. and 5,046,521 to Jensen all are illustrative of such prior art. While these units may be suitable for the particular purpose to which they address, they would not be as suitable for the purpose of the present invention as hereafter described.

SUMMARY OF THE INVENTION

A primary object of the present invention is to provide a prefabricated water plumbing station that will overcome the shortcomings of the prior art devices.

Another object is to provide a prefabricated water plumbing station that is a complete single unit with all required components for installation in a wall cavity between two vertical studs, so as to permit the control of hot and cold water and to direct waste water back into a waste drainage system.

An additional object is to provide a prefabricated water plumbing station as a installation time saving single component that can be utilized in an available wall cavity of any size dwelling, commercial building, recreational facility, motel/hotel, restaurant, industrial complex or any other building as may be required by plumbers and/or other charge with such installation.

A further object is to provide a prefabricated water plumbing station that is simple and easy to use.

A still further object is to provide a prefabricated water plumbing station that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
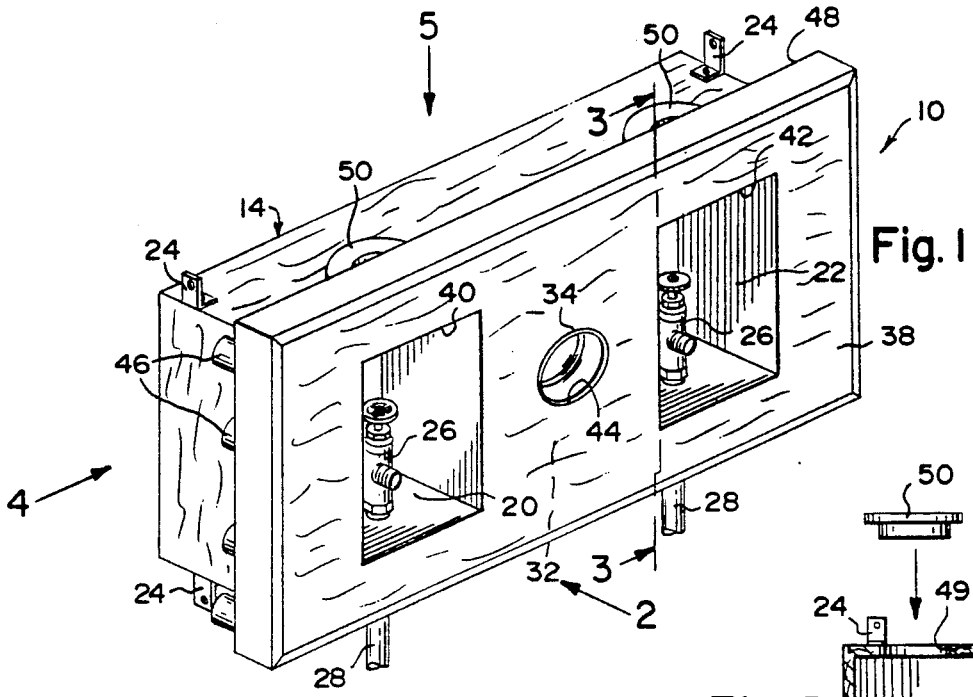
FIG. 1 is a diagrammatic perspective view of a typical embodiment of the instant invention.
Figure 2:
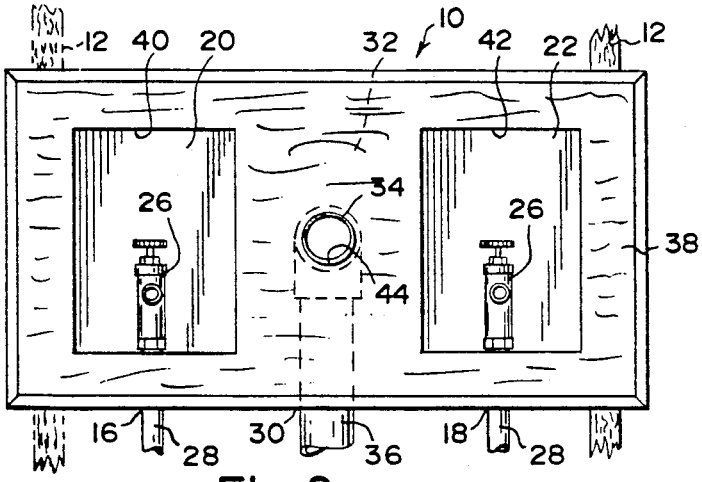
FIG. 2 is an elevational view taken in the direction of arrow 2 in FIG. 1.
Figure 3:
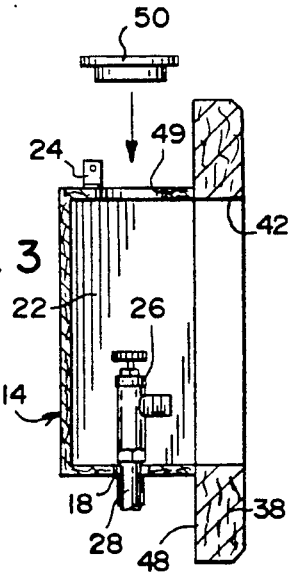
FIG. 3 is a cross sectional view taken on line 3—3 in FIG. 1.
Figure 4:
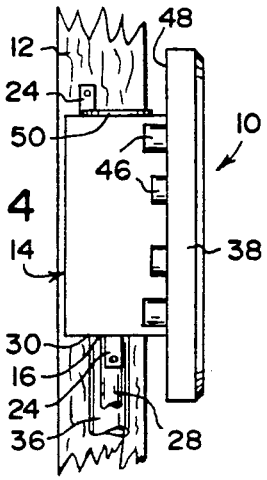
FIG. 4 is an elevational view taken in the direction of arrow 4 in FIG. 1.
Figure 5:
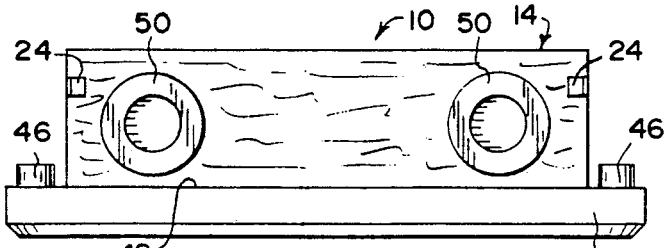
FIG. 5 is an elevational view taken in the direction of arrow 5 in FIG. 1.

Turning now descriptively to the drawings, in which similar reference characters denote similar elements throughout the several views, the Figures illustrate a prefabricated water plumbing station 10 for installation in a wall cavity between two vertical studs 12 to receive hot and cold water pipe connections of a fixture/appliance, which consists of a housing 14 having hot and cold water inlet ports 16 and 18 in registry with hot and cold water outlet compartments 20 and 22. A plurality of hangers 24 are provided for mounting the housing 14 between the two vertical studs 12 in the wall cavity, so that the hot and cold water outlet compartments 20 and 22 face outwardly therefrom. A pair of valves 26 are provided with a pair of pipe stubs 28, each connected to one of the valves 26. The valves 26 are positioned within the hot and cold water outlet compartments 20 and 22, with the pipe stubs 28 extending through the hot and cold water inlet ports 16 and 18 to connect to hot and cold water supply pipes in the wall cavity, while the valves 26 will connect to the hot and cold water pipe connections of the fixture/appliance.

The housing 14 has a waste water delivery port 30 in registry with a (closed) waste water inlet compartment 32. The waste water delivery port 30 is located between the hot and cold inlet ports 16 and 18. The waste water inlet compartment 32 is located between the hot and cold water outlet compartments 20 and 22. An elbow fitting 34 is provided with a drain pipe stub 36 connected to the elbow fitting 34. The elbow fitting is positioned within the waste water inlet compartment 32 with the drain pipe stub 36 extending through the waste water delivery port 30 to connect to a drainage pipe, while the elbow fitting 34 will connect to a drain connection of the fixture/appliance.

The housing 14 further includes an enlarged front panel 38 having a pair of openings 40 and 42 and an aperture 44 therebetween. The openings 40 and 42 are of the same size and are in alignment with the hot and cold water outlet compartments 20 and 22 to expose the valves 26 therein. The aperture 44 is in alignment with the elbow fitting 34 in the waste water inlet compartment 32. Typically two sets of different length alignment lugs 46 are illustrated on a rear surface 48 of the front panel 38 at opposite side ends thereof. In use all or all but one set of the alignment lugs 46 may be broken away from the unit and discarded, as is required by the parameters of a particular installation. The one set of the alignment lugs 46 that is chosen and is used to butt against the two vertical studs 12, automatically positions the enlarged front panel 38 at a proper distance from the vertical studs 12, allowing for the installation wall surface material, typically paneling, sheet rock and similar materials to the vertical studs 12 about and beneath the enlarged front panel 38 after the unit has already been secured to the studs.

The housing 14 has a pair of auxiliary holes 49 located opposite from the hot and cold inlet ports 16 and 18, so as to permit axially inline access with a screw driver blade or other tool required service the valves 26. These auxiliary holes 49 also allow the housing 14 to be fabricated separately and then have the valve 26 and pipe stub 28 installed therein as subassemblies during the fabrication of the instant invention. A pair of removable caps 50 are also provided, with each to fit into one of the auxiliary holes 49, when the auxiliary holes are not being used.

The pipes 28 and 36 may either be forced fitted into their respective openings 16, 18 and 30 or cemented with and appropriate adhesive as a manufactures design choice depending upon the selection of material used for the housing typically wood or plastic and pipe typically plastic or metal.

It is to be particularly noted and understood that although through out this specification the instant invention is generally referred to as a prefabricated water plumbing station a less limiting choice of title might be just prefabricated plumbing station because units might just as well be constructed for the delivery and transfer of gases, oxygen or any other fluids required for a particular construction site i.e. typically hospitals, commercials buildings, chemical plants, and a host of other to numerous to mention and therefore this specification is to be interpreted in the broadest sense.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A prefabricated water plumbing station for installation in a wall cavity between two vertical studs to receive hot and cold water pipe connections of a fixture/appliance, which comprises:

a) a housing having hot and cold water inlet ports in registry with hot and cold water outlet compartments further including:

i) said housing having a waste water delivery port in registry with a waste water inlet compartment in which the waste water delivery port is located between the hot and cold inlet ports, while the waste water inlet compartment is located between the hot and cold water outlet compartments;

ii) an elbow fitting; and iii) a drain pipe stub connected to said elbow fitting, wherein said elbow fitting is positioned within the waste water inlet compartment with said drain pipe stub extending through the waste water delivery port to connect to a drainage pipe, whereby said elbow fitting will connect to a drain connection of the fixture/appliance;

b) a plurality of hangers for mounting said housing between the two vertical studs in the wall cavity, so that the hot and cold water outlet compartments face outwardly therefrom;

c) a pair of valves; and d) a pair of pipe stubs, each connected to one of said valves, wherein said valves are positioned within the hot and cold water outlet compartments with said pipe stubs extending through said hot and cold water inlet ports to connect to hot and cold water supply pipes in the wall cavity, whereby said valves will connect to the hot and cold water pipe connections of the fixture/appliance, wherein said housing further includes:

i) an enlarged front panel having a pair of openings and an aperture therebetween, the openings being of the same size and in alignment with the hot and cold water outlet compartments to expose said valves therein, and the aperture in alignment with said elbow fitting in the waste water inlet compartment; and ii) at least one set of different length alignment lugs on a rear surface of said front panel at opposite side ends thereof, wherein one set of said alignment lugs may be chosen and used to butt against the two vertical studs, to automatically position said enlarged front panel at a proper distance from said vertical studs, allowing for the installation of paneling and similar materials to the vertical studs about said enlarged front panel.

2. A prefabricated water plumbing station as recited in claim 1, further including:

a) said housing having a pair of auxiliary holes located opposite from the hot and cold inlet ports; and b) a pair of removable caps, each to fit into one of the auxiliary holes when the auxiliary holes are not being used.

* * * * *